US012588789B2

(12) United States Patent
Haugabrook

(10) Patent No.: US 12,588,789 B2
(45) Date of Patent: Mar. 31, 2026

(54) SYSTEM, APPARATUS AND METHOD FOR TOILETRY CONVENIENCE

(71) Applicant: Stephen Haugabrook, Virginia Beach, VA (US)

(72) Inventor: Stephen Haugabrook, Virginia Beach, VA (US)

( * ) Notice: Subject to any disclaimer, the term of this patent is extended or adjusted under 35 U.S.C. 154(b) by 95 days.

(21) Appl. No.: 18/397,641

(22) Filed: Dec. 27, 2023

(65) Prior Publication Data

US 2024/0215773 A1 Jul. 4, 2024

Related U.S. Application Data

(60) Provisional application No. 63/436,930, filed on Jan. 4, 2023.

(51) Int. Cl.
*A47K 10/32* (2006.01)

(52) U.S. Cl.
CPC ..... *A47K 10/32* (2013.01); *A47K 2010/3233* (2013.01); *A47K 2010/3253* (2013.01)

(58) Field of Classification Search
None
See application file for complete search history.

(56) References Cited

U.S. PATENT DOCUMENTS 780,418 A * 1/1905 Garlick ..... A47K 10/24 221/277
3,100,066 A 8/1963 Campbell
3,754,804 A 8/1973 Cushman
4,641,898 A 2/1987 Horowitz et al.
5,269,599 A * 12/1993 Moring ..... A47B 46/005 312/902
5,377,866 A 1/1995 Watters
7,222,747 B1 * 5/2007 Savran ..... A47K 10/42 221/45
7,882,796 B2 * 2/2011 Radow ..... A47B 69/00 312/351
9,161,621 B1 10/2015 Huffin
2007/0012714 A1 * 1/2007 Bagwell ..... A47K 5/12 221/33
2007/0084737 A1 * 4/2007 Cook ..... A47K 10/3827 206/223
2007/0095769 A1 * 5/2007 Jenkins ..... A47K 10/38 211/119.009
2009/0045083 A1 * 2/2009 Vaults, Jr. ..... A47K 17/00 206/391
2016/0303598 A1 10/2016 Rifkin
2021/0186274 A1 * 6/2021 Mechenbier ..... G01F 15/068
2021/0307568 A1 10/2021 Steinke

FOREIGN PATENT DOCUMENTS

KR 200463260 Y1 11/2012
KR 102027151 B1 10/2019

OTHER PUBLICATIONS

Written Opinion for PCT/US23/86059, dated Apr. 14, 2024.
Search Report for PCT/US23/86059, dated Apr. 14, 2024.

* cited by examiner

*Primary Examiner* — Steven M Marsh
(74) *Attorney, Agent, or Firm* — Tariq Najee-Ullah; GIBRALTAR CONSULTING

(57) ABSTRACT

Toiletry care tools, devices, apparatuses, systems, methods and improvements upon the usage and access of toiletries while in a bathroom. The instant invention is a cabinet, container or box that conveniently houses the various toiletries, including toilet paper, tampons, and other amenities. The container has a flexible arm, lid and other features.

20 Claims, 4 Drawing Sheets

SYSTEM, APPARATUS AND METHOD FOR TOILETRY CONVENIENCE

CROSS REFERENCE TO RELATED APPLICATION

The present invention is a nonprovisional of and claims priority to U.S. Provisional Patent Application Ser. No. 63/436,930, filed Jan. 4, 2023, entitled "SYSTEM, APPARATUS AND METHOD FOR TOILETRY CONVENIENCE," the disclosure of which is incorporated herein by reference.

FIELD OF THE INVENTION

The present invention is directed to improvements in techniques and adjustable equipment for individuals to conveniently use toiletries and other materials by providing storage and ease of access facilities.

BACKGROUND OF INVENTION

A basic need for mankind is the need to relieve waste when needed, whether at home or remotely. At that time, the requisite toiletries should be within arm's reach while seated on a toilet and in a single location.

Although some toiletries are used by men and women, such as toilet paper and wipes, other toiletries, such as feminine tampons and liners are also needed. Additional toiletries, such as sanitizers, toilet sprays and other items may also be available. Again, convenience demands that all of these items be within easy reach.

Since the placement of the toilet in a room may compromise a regular placement of a convenience apparatus in relation thereto, the exigent needs of the person on the toilet demand an apparatus that is versatile and adaptable to different placements at or near a toilet, and always within an arm's reach.

The growing diversity of toiletry products has also created a situation where the various and diverse products are often stored in different places. There is thus a need for a system and product to centralize the various toiletry products in an apparatus or device to conveniently hold and store them, again within arm's reach at the moment needed, thereby negating a need to call out for help. The device would also be optimized to hold and store products for both males and females, without the need for either of them to stand or move beyond arm's reach.

With toiletry products and apparatuses being a large industry, any improvements to make more toiletry conveniences available would increase usage of such devices and would satisfy a great need. There is also a need for these products to be flexible in usage, adaptable and configurable for a variety of bathroom circumstances.

There is, therefore, a present need to provide an improved system, device, apparatus, methodology or kit to improve a user's conveniences while using a toilet and bathroom.

SUMMARY OF THE PRESENT INVENTION

The present invention is directed to tools, devices, apparatuses, systems, methods and improvements upon the usage and access of toiletries while in a bathroom. The instant invention is a container, cabinet or box that conveniently houses the various toiletries, including toilet paper, tampons, and other amenities. In other embodiments, the container has a flexible arm, lid and other features.

BRIEF DESCRIPTION OF THE DRAWINGS

While the specification concludes with claims particularly pointing out and distinctly claiming the subject matter that is regarded as forming the present invention, it is believed that the invention will be better understood from the following description taken in conjunction with the accompanying DRAWINGS, where like reference numerals designate like structural and other elements, in which:

DETAILED DESCRIPTION OF THE PRESENT INVENTION

The present invention will now be described more fully hereinafter with reference to the accompanying DRAWINGS, in which preferred embodiments of the invention are shown. It is, of course, understood that this invention may, however, be embodied in many different forms and should not be construed as limited to the embodiments set forth herein; rather, these embodiments are provided so that the disclosure will be thorough and complete, and will fully convey the scope of the invention to those skilled in the art. It is, therefore, to be understood that other embodiments can be utilized, and structural changes can be made without departing from the scope of the present invention.

The present invention is generally directed to an improved apparatus, device, system, kit and technique for individuals to personally access during their normal daily routine answering nature's call. The instant invention is the result of various observations and experimentations of the Applicant to improve upon this basic need. The incorporation of the diverse toiletries into a centralized container, cabinet or box proved to be a challenge.

The great variety of possible positions of the container vis-à-vis the toilet and the user sitting thereon had to be addressed also. Preferably, the system of the present invention provides not only accessibility but also storage, e.g., a number of toilet rolls are stored therein for easy access.

Figure 1:
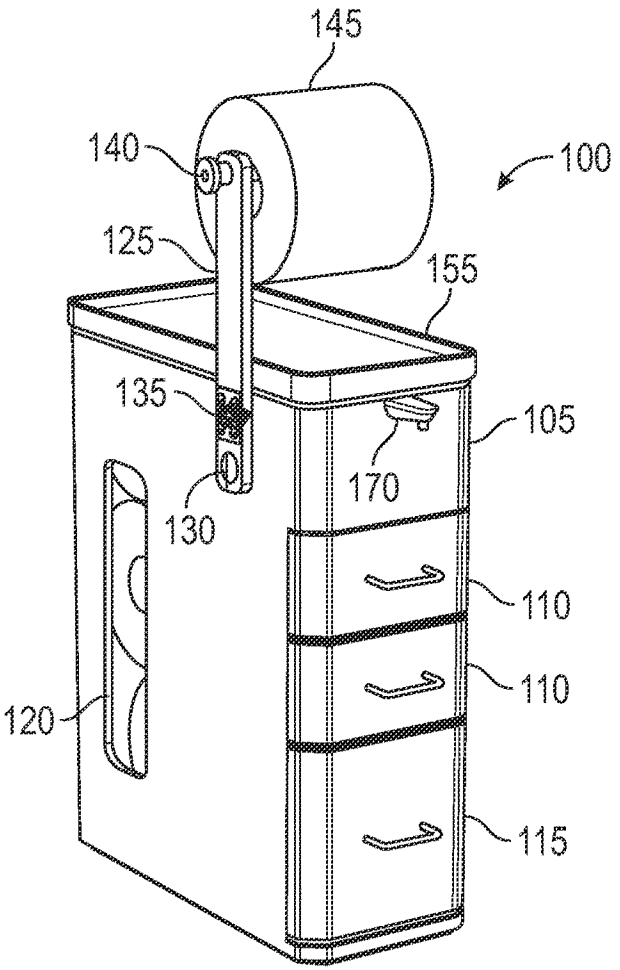
FIG. 1 is a representative perspective front view of a container or cabinet device in a currently preferred embodiment that may be employed using the principles of the present invention.

With reference now to FIG. 1 of the DRAWINGS, there is illustrated a representative configuration of an embodiment of an improved system practicing the principles of the present invention shown in a first perspective. The simple, flexible and versatile system configuration shown, generally designated by the reference numeral 100, has a toilet paper dispenser, described further hereinbelow, drawers for other items, such as women's toiletries, cotton swabs or other items, a sensor, which when activated dispenses a measure of liquid, such as a sanitizer, and a toilet paper roll arm, which is preferably articulated and adjustable for a range of positions and use, as described further hereinbelow.

As shown, the system 100 has a cabinet portion or cabinet, generally designated by the reference numeral 105, with storage drawers, generally designated by the reference numeral 110. The cabinet 105 also has a pivotable drawer, generally designated by the reference numeral 115, preferably with a spring hinge, described further hereinbelow.

As mentioned, the cabinet 105 also serves as a repository for rolls of toilet paper. The cabinet 105 has a transparent window, generally designated by the reference numeral 120, whereby the user can visually and easily ascertain the status of the toilet paper supply within the cabinet 105, Also shown is an arm, generally designated by the reference numeral 125, for deploying a particular toilet roll, generally designated by the reference numeral 145, for immediate use, whereby the arm 125 includes a standard toilet paper roll suspension mechanism, generally designated by the reference numeral 140 at an end thereof. Also shown is cabinet cover, generally designated by the reference numeral 155.

Figure 2:
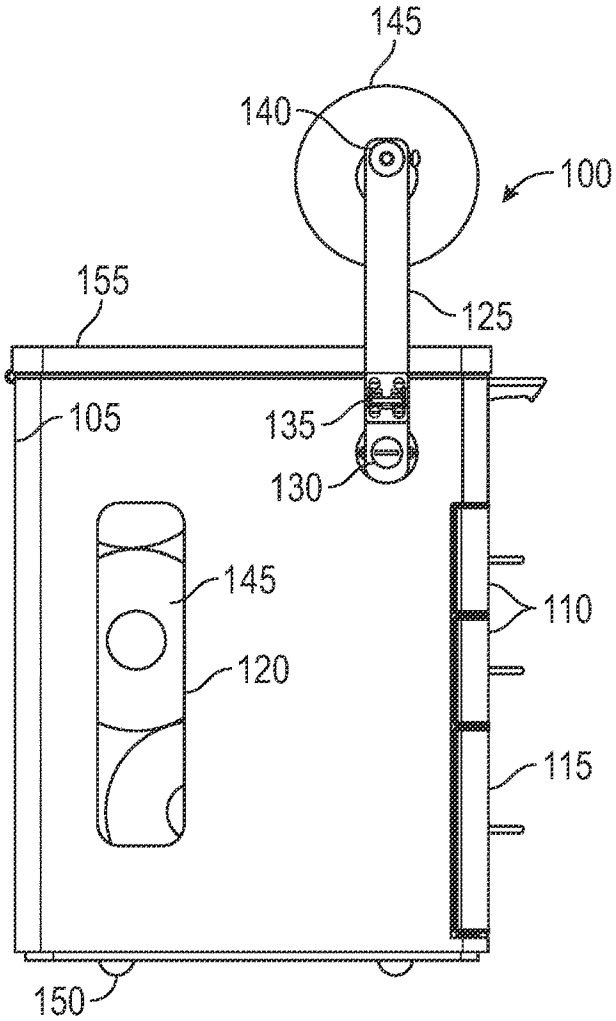
FIG. 2 is a side view of the cabinet device of FIG. 1 further illustrating the principles of the present invention.

With reference now to FIG. 2 of the DRAWINGS, there is illustrated the system 100 of the embodiment shown in FIG. 1 in a side view. The simple, flexible and versatile configuration 100 is shown along the side, which further illustrates the aforesaid toilet paper window 120, with a number of toilet rolls 145 therein.

As discussed, the arm 125 deploying the toilet paper roll 145 is shown affixed to the side if the cabinet 105 at another end thereof. In particular, the arm 125 is shown in a vertical alignment, with the alignment being adjustable by a tension screw, generally designated by the reference numeral 130, whereby the user can configure the position of the toilet paper roll 145 vis-à-vis their needs, e.g., in a horizontal configuration, such as shown hereinbelow in FIG. 4. As shown in FIG. 2, the arm 125 includes a friction hinge, generally designated by the reference numeral 135, which allows freedom of operation along another axis, as shown and described in more detail with regard to FIG. 8, discussed hereinbelow, e.g., in connection with easily changing a toilet paper roll 145 on the suspension mechanism 140.

Figure 3:
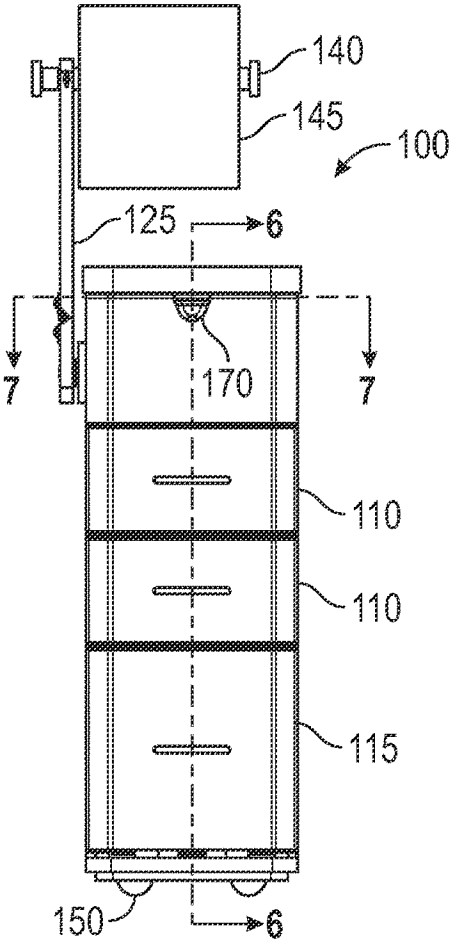
FIG. 3 s a front view of the cabinet device shown in FIGS. 1 and 2 pursuant to the teachings of the instant invention.

With reference now to FIG. 3 of the DRAWINGS, the system 100 shown in FIGS. 1 and 2 is depicted in a front view. As shown, the system 100 has two drawers 110 and a pivot drawer 115. Also shown are a number of bumper feet, generally designated by the reference numeral 150, which keep the cabinet 105 elevated and moisture-free, thereby promoting cleanliness. As in FIGS. 1 and 2, the arm 125 and roll holder apparatus 140 are shown in a vertical alignment.

Figure 4:
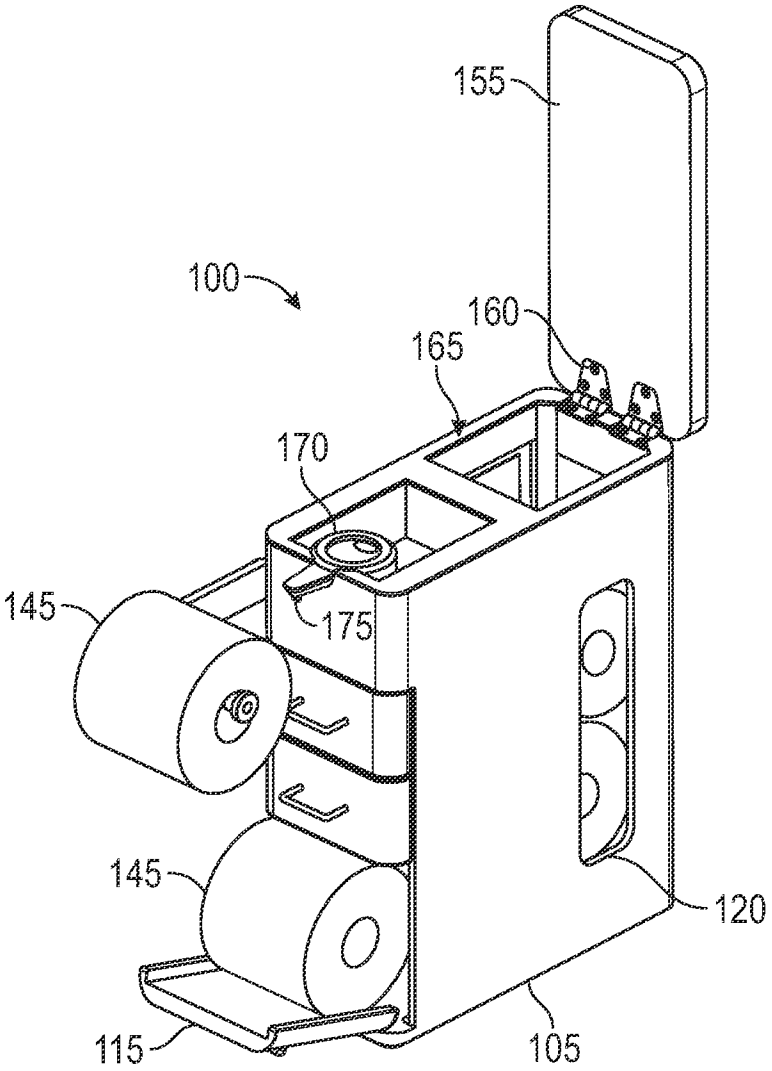
FIG. 4 is a perspective front view of the cabinet device shown in FIGS. 1-3, illustrated with a cover and drawer open, and an arm down.

With reference now to FIG. 4, there is shown the system 100 in an open configuration, i.e., the cover 155 is up. Also, the arm 125 is shown deployed in a horizontal configuration, i.e., the adjustable screw 130 was loosened, the arm 125 configured downward and the screw 130 then tightened by the user. As shown, the cover 155 rotates across hinges, generally designated by the reference numeral 160, and has means to maintain its vertical position. With the interior of the cabinet 105 open, a recess, generally designated by the reference numeral 165, is shown, whereby toilet paper rolls 145 can be inserted therein, i.e., in restocking the supply. Some of these stored toilet paper rolls 145 can be seen through the window 120, and also extending out of the pivot drawer 115. It should be understood that that the pivot drawer 115 is preferably a spring hinge that closes and keeps the stored toilet paper rolls 145 in place until needed.

It should be understood that gravity keeps the toilet paper rolls 145 within the cabinet 105 primed and ready, e.g., the opening of the pivot door 115 allows the supply of toilet paper rolls 145 to become visible and available for use. If not needed, the user merely has to push the spring hinge of the pivot door 115 shut, thereby securing the stored rolls 145 in a protected environment for later use.

Also shown is a soap dispenser, such as a SimpleHuman 9 oz dispenser, generally designated by the reference numeral 170, which is integrable with the cabinet 105. Additionally, the soap dispenser can be automated to dispense a measure or dollop of soap, e.g., in response to the user moving their hand adjacent the soap dispenser 170, a sensor, generally designated by the reference numeral 175, can automate the dispersal of soap, e.g., through use of an infrared sensor 175.

Figure 5:
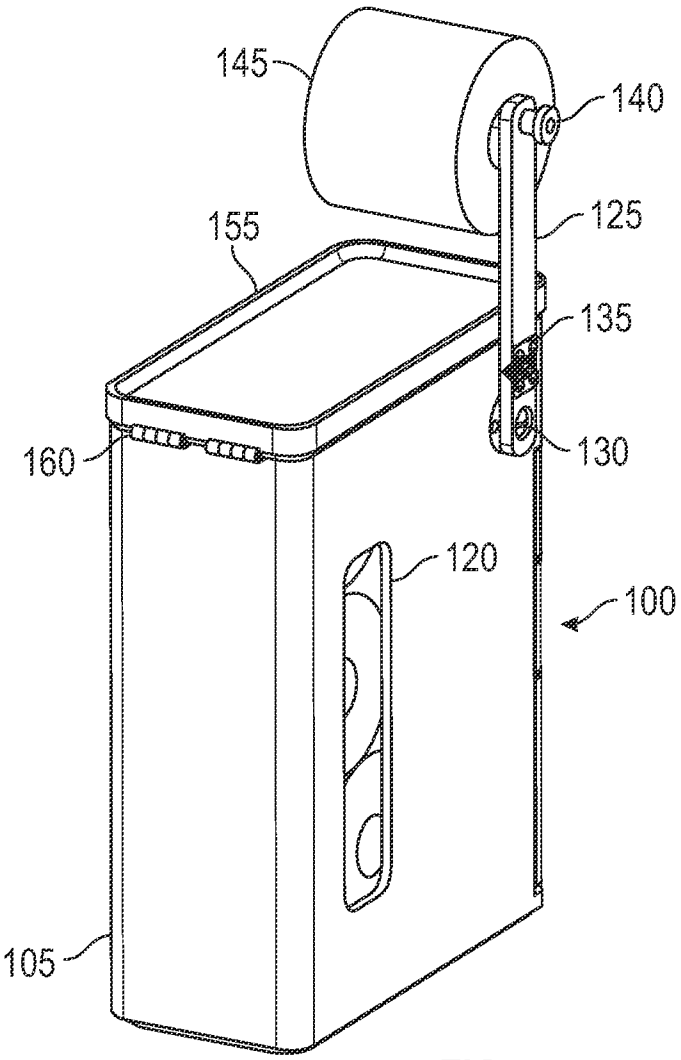
FIG. 5 is a perspective back view of the cabinet device shown I FIGS. 1-4

With reference now to FIG. 5 of the DRAWINGS, there is shown the system 100 of FIGS. 1-4 depicted from behind, illustrating the hinges 160 for the cover 155.

Figure 6:
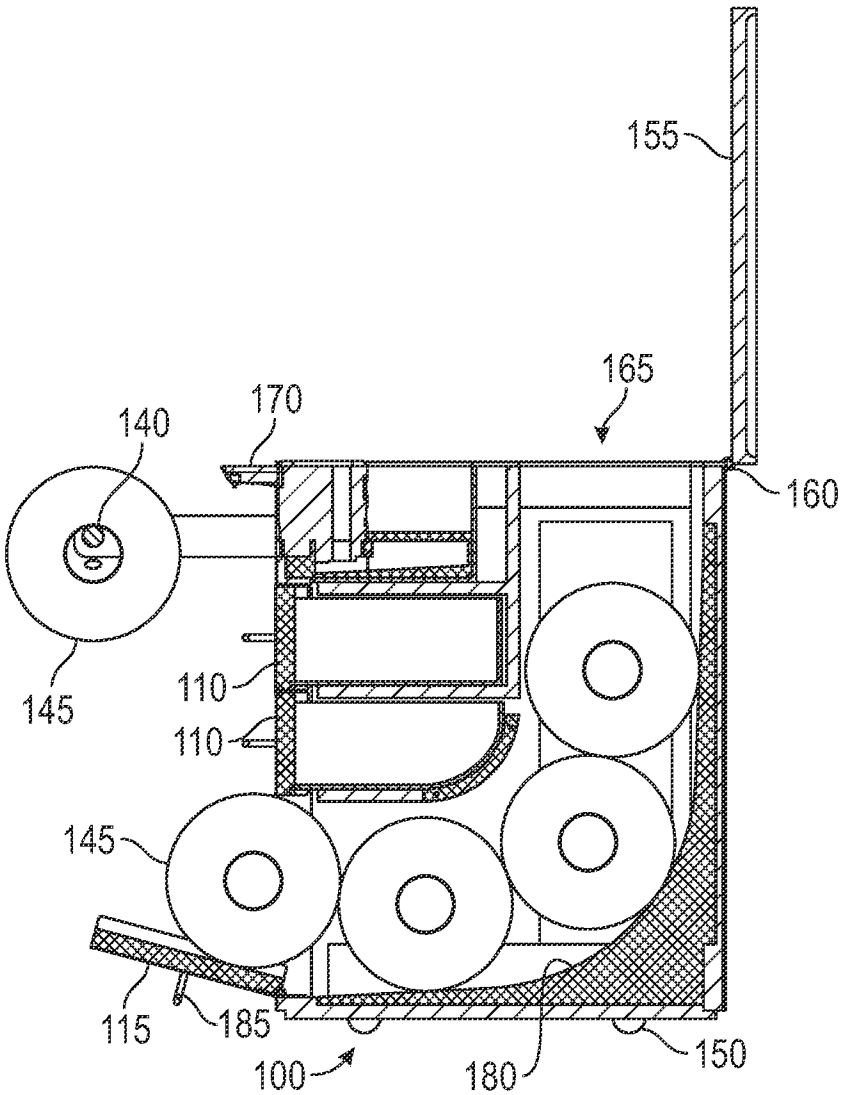
FIG. 6 is a cross sectional view of the device shown in FIG. 3, along 6-6, further illustrating the principles of the present invention.

Turning now to FIG. 6, which is a cross-sectional side view of FIG. 3 along the bisector 6-6, the cover 155 is shown up, and a number of toilet rolls 145 are shown employed in the recess 165 and extending onto the opened pivot drawer 115 illustrated. The drawers 110 are shown, which can hold a variety of bathroom, feminine, men's, and child products. Also shown is the soap dispenser 170 and the sensor 175.

Figure 7:
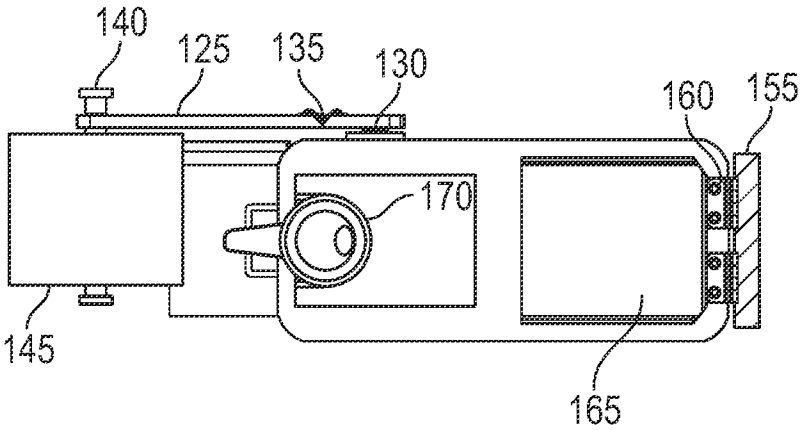
FIG. 7 is another cross sectional view of the device shown in FIG. 3, along 7-7, illustrating the instant invention.

Turning now to FIG. 7, which is another cross-sectional top view of FIG. 3 along the bisector 7-7, the toilet paper roll 145 is again in a horizontal and forward configuration, which allows the cover 155 to open. The recess 165 is shown, along with the soap dispenser 170.

Figure 8:
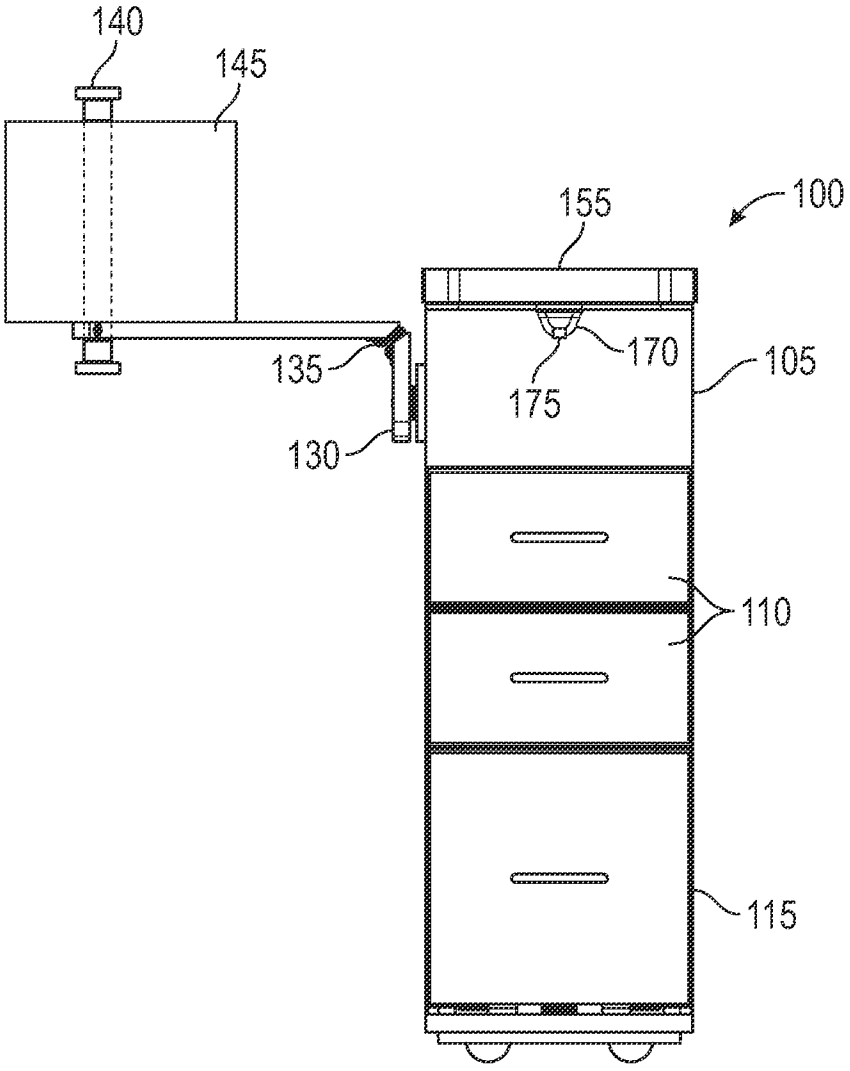
FIG. 8 illustrates another currently preferred embodiment of a cabinet device employing the principles of the present invention.

Lastly, turning to FIG. 8 of the DRAWINGS, there is shown the system 100 in another configuration. In particular, the arm 125 is rotated about the friction hinge 135, tilting the roll holder 140 into a position to allow ease of insertion of a new toilet paper roll 145, as shown. Of course, when the user has replaced the toilet paper roll 145, the arm 125 is rotated back and redeployed, e.g., in the aforesaid horizontal or vertical configurations.

As shown, the aforesaid articulated arm 125 has a high degree of movement or arc about the fixation point of the arm to the cabinet 105, e.g., 360 degrees thereabout, permitting great flexibility in positioning the system 100 for the intended functions. Importantly, the toilet paper rolls 145 stored within the cabinet 105 are both protected and easily accessible.

As shown in the DRAWINGS, the system configuration 100 of the embodiment shown in FIG. 6 hereinabove, particularly showing the cabinet 105 in cross section has a number of toilet paper rolls 145 queued within the cabinet 105, where gravity assists in their dispersal at the bottom. To further ensure delivery of the rolls to the aforesaid pivot or pulldown door 115, the interior recess 165 of the cabinet 105 is sloped, e.g., using a sloped portion, generally designated by the reference numeral 180, so that gravity can further assist in pushing the rolls 145 to the access point. Six or more rolls can be so queued. A position peg, generally designated by the reference numeral 185, is also shown to best position the toilet paper rolls 145 so they do not roll out and off the pivot drawer 115.

As also shown in the DRAWINGS, the soap dispenser or sanitizer bottle 170 or other liquid is located on a shelf within the cabinet 105 and connected to a dispersal nozzle, as shown, extending outward for ease of use. Further, the aforementioned sensor 175 (and the electronics therefor) can govern the dispersal of the liquid/sanitizer, e.g., the user, wishing to cleanse their self, may wave their hand over the sensor to activate the dispersal of the sanitizer, e.g., by activating an Infrared sensor 175. Further, a user, wishing to moisten a wad of the toilet paper 145 for use, can move the wad under the dispenser 170 to trigger the sensor and the liquid comes out. It should be understood that in a mechanical version, the dispersal may also be mechanical, i.e., pumped by the user. In this fashion, the system 100 configuration becomes a one-stop, easy access system for use.

It should be understood that although the arm 125 is shown securely affixed to the side of the cabinet 100, the arm 125, in tight configurations, could instead be deployed at the top 155 of the container 100.

It should be understood that the compositional materials of the instant invention, as shown in the various embodiments, can be wood, plastic, silicone, a wood/silicone composite, and other materials as is understood to one of skill in the arts. For example, the metal components are preferably made of 304 stainless steel metal. It should be understood that alternative materials are also possible. The invention should be configured for ease of cleaning as demanded by the environment of use. Thus, plastic materials would be preferred.

It should also be understood that the system 100 configurations can be deployed or mounted on a wall with the requisite brackets, e.g., mounted securely along the back side, provided the arrangement allows access all around, e.g., 3-5 inches, for versatility in use. The system 100 can also rest on the floor. In another embodiment, the cabinet 100 may include a kickstand or other such feature to provide more support, including if weight is placed on the cabinet 100.

The previous descriptions are of preferred embodiments for implementing the invention, and the scope of the invention should not necessarily be limited by these descriptions. It should be understood that various alternatives and equivalents are encompassed herein. The scope of the current invention is defined by the following claims.

What is claimed is:

1. A toiletry care system comprising:

a cabinet, said cabinet further comprising;

a first compartment comprising a spindle and housing for supporting and dispensing a toilet paper roll;

a second compartment adjacent to the first compartment, the second compartment defining an elongated fluid reservoir;

a foaming nozzle fluidly coupled to the reservoir, the nozzle comprising an intake channel and a narrowing outlet configured to mix liquid soap and ambient air to form foam;

a manually operable actuator disposed on the second compartment, the actuator in fluid communication with the nozzle and operable to dispense foam without the use of electrical power;

wherein the first and second compartments are integrally formed in a single chassis and configured to be mounted to a vertical surface;

wherein the toilet paper roll and the reservoir are independently refillable through respective access openings;

said cabinet having an adjustable toilet paper roll arm secured along a side thereof, where a given toilet paper roll is deployed for use;

at least one sensor, said at least one sensor deployed on said cabinet adjacent said liquid dispenser, said at least one sensor configured to dispense said liquid upon a given motion being detected.

2. The toiletry care system according to claim 1, wherein said cabinet has a transparent portion.

3. The toiletry care system according to claim 1, wherein said lowest drawer access point is a pulldown drawer.

4. The toiletry care system according to claim 1, wherein said cabinet has a top portion, said top portion pivotable, whereby a recess is uncovered, said recess being configured to receive a plurality of said toilet paper rolls.

5. The toiletry care system according to claim 4, wherein said recess has a sloped portion therein sloping to said lowest drawer, whereby toilet paper rolls stored within said cabinet will slope toward said access point.

6. The toiletry care system according to claim 1, wherein said adjustable toilet paper roll arm rotates at a first point along a first axis.

7. The toiletry care system according to claim 6, wherein said adjustable toilet paper roll arm and said given toilet paper roll being adjustable along said first axis.

8. The toiletry care system according to claim 7, comprising an adjustable screw, said adjustable screw when tightened affixing said given toilet paper roll at a given angle along said first axis.

9. The toiletry care system according to claim 6, wherein said adjustable toilet paper roll arm rotates at a second point along a second axis, said second axis being perpendicular to said first axis.

10. The toiletry care system according to claim 9, wherein said adjustable toilet paper roll arm and said given toilet paper roll being adjustable along said second axis.

11. The toiletry care system according to claim 10, comprising a friction hinge, said friction hinge when tightened affixing said given toilet paper roll at a given angle along said second axis.

12. A toiletry care system comprising:

a cabinet having a plurality of storage compartments;

a first compartment within the cabinet configured to store a plurality of toilet paper rolls in a gravity-fed arrangement;

a dispensing compartment positioned below the first compartment and configured to provide access to the toilet paper rolls;

an adjustable arm assembly secured to the cabinet and configured to support a toilet paper roll for dispensing;

a liquid dispensing assembly integrated within the cabinet and configured to dispense a measured quantity of liquid; and a sensor operatively connected to the liquid dispensing assembly and configured to activate liquid dispensing upon detecting motion.

13. The toiletry care system according to claim 12, wherein the first compartment comprises a sloped interior surface configured to direct the toilet paper rolls toward the dispensing compartment under gravitational force.

14. The toiletry care system according to claim 12, wherein the adjustable arm assembly comprises a multi-axis articulation mechanism configured to position the toilet paper roll in a plurality of spatial orientations.

15. The toiletry care system according to claim 14, wherein the adjustable arm assembly comprises a first pivot joint configured to rotate about a vertical axis and a second pivot joint configured to rotate about a horizontal axis.

16. The toiletry care system according to claim 12, wherein the cabinet comprises a transparent viewing window positioned to permit visual inspection of toilet paper roll inventory within the first compartment.

17. A unitary toiletry dispenser apparatus comprising:

a housing structure defining multiple internal compartments;

a roll storage chamber configured to accommodate multiple rolls of sheet material in a stacked configuration;

a roll access mechanism positioned to provide selective access to individual rolls from the roll storage chamber;

an articulated dispensing arm mounted to the housing structure and configured to position a roll of sheet material at multiple orientations;

a liquid reservoir compartment integrated within the housing structure;

a dispensing nozzle fluidly connected to the liquid reservoir compartment; and an activation mechanism configured to control liquid dispensing from the dispensing nozzle.

18. The unitary toiletry dispenser apparatus according to claim 16, wherein the roll access mechanism comprises a spring-loaded drawer configured to retain the rolls within the roll storage chamber and provide controlled access thereto.

19. The unitary toiletry dispenser apparatus according to claim 16, wherein the activation mechanism comprises an infrared sensor configured to detect hand motion and trigger liquid dispensing without physical contact; and wherein the housing structure comprises mounting provisions configured to secure the apparatus to a vertical wall surface or position the apparatus on a floor surface.

20. The toiletry care system according to claim 12, wherein the adjustable arm assembly comprises a tension adjustment mechanism configured to secure the toilet paper roll at a selected angular position relative to the cabinet.

* * * * *